US005769284A

United States Patent [19]

Vargas et al.

[11] Patent Number: 5,769,284

[45] Date of Patent: Jun. 23, 1998

[54] SELF-ADJUSTING PICK-UP TUBE ASSEMBLY FOR ASPIRATING LIQUID FROM CONTAINERS

[75] Inventors: Santos E. Vargas, Miami Lakes; Thomas Wollitzer, North Miami Beach, both of Fla.

[73] Assignee: Coulter International Corp., Miami, Fla.

[21] Appl. No.: 623,473

[22] Filed: Mar. 28, 1996

[51] Int. Cl.[6] ..... B67D 5/60

[52] U.S. Cl. ..... 222/464.4; 222/464.6

[58] Field of Search ..... 222/464.4, 464.6, 222/464.5

[56] References Cited

U.S. PATENT DOCUMENTS 558,131 4/1896 Warren ..... 222/464.6 X 4,273,272 6/1981 Blanc ..... 222/464.4

5,195,664 3/1993 Rhea ..... 222/464.4

FOREIGN PATENT DOCUMENTS 2 031 526 4/1980 United Kingdom ..... 222/464.4

*Primary Examiner*—Gregory L. Huson

*Attorney, Agent, or Firm*—Warren W. Kurz

[57] ABSTRACT

A self-adjusting pick-up tube assembly for aspirating liquid from containers of varying heights. Such assembly comprises (a) a platform member adapted to be positioned in contact with the bottom of a container when the pick-up tube is being used to aspirate liquid from such container; (b) a disk-shaped member adapted to be retained in a position proximate the container's liquid filling aperture when the pick-up tube is in use; (c) a flexible conduit interconnecting respective liquid passageways in the platform and disk-shaped members, and (d) a telescopic mount for enabling relative movement between the platform and disk-shaped members to accommodate containers of different height.

12 Claims, 3 Drawing Sheets

SELF-ADJUSTING PICK-UP TUBE ASSEMBLY FOR ASPIRATING LIQUID FROM CONTAINERS

BACKGROUND OF THE INVENTION

1. Field of the Invention

The present invention relates to improvements in apparatus for aspirating liquid from containers. More particularly, it relates to improvements in so-called "pick-up tubes" which are adapted to cooperate with a vacuum source to aspirate the entire contents of a liquid-filled container through the top of the container.

2. Discussion of the Prior Art

In many technical disciplines, it is desirable to aspirate liquid from a container through the container's filling aperture, usually located at or near the top of the container. As shown in FIG. 1, apparatus for performing this task commonly comprises a pick-up tube assembly T which can be releasably connected to a container C and coupled to a vacuum source V. The pick-up tube assembly usually comprises an elongated and rigid tube 10 (shown substantially enlarged for the sake of illustration) and some screw-on mechanism 11 for rigidly coupling the tube to the filling aperture A of the container. The tube length is fixed, being selected to approximate the vertical distance D between the container's filling aperture and its bottom B. A portion of the tube's upper end 10A extends through a circular disk 14 which forms a part of the pick-up tube assembly and serves to suitably position the pick-up tube in the container's filling aperture. Disk 14 has a diameter which is slightly greater than the diameter of the container's filling aperture, whereby the disk may rest upon and be supported by the rim 16 of the filling aperture. Disk 14 is usually clamped in place atop the filling aperture by a threaded cap 18 which engages threads formed in the exterior of a short tubular section 19 surrounding the filling aperture. The tube's upper end 10A is adapted to engage a flexible conduit 20 through which liquid in the container can be aspirated by the vacuum source. Ideally, the length of the rigid tube inside the container is selected so that the tube's lower end 10B rests on the container bottom when disk 14 is clamped in place atop the container by cap 18. As shown, a small notch 22 is often formed in the bottom of the pick-up tube to enable liquid at the container bottom to enter the tube.

From FIG. 1, it will be appreciated that the length of the pick-up tube inside the container must vary to assure the complete emptying of containers of different height. If the tube length is too short, the lower end of the tube will not reach the container bottom, and the container cannot be emptied; if the tube is too long, disk 14 cannot be properly seated on and connected to the container top.

Heretofore, it has been common for either the container manufacturer or the provider of the liquid sold in the container to incorporate a pick-up tube having a length which is particularly adapted for use with the container in which it is sold. This solution to the problem adds considerable cost to the container and, accordingly, is to be avoided.

SUMMARY OF THE INVENTION

In view of the foregoing discussion, an object of this invention is to provide a self-adjusting pick-up tube assembly of the above type which capable of being used in a variety of containers of differing heights.

The above object is achieved by the provision of a self-adjusting pick-up tube assembly in which the distance between the tube's top and bottom is automatically varied to accommodate different container heights as the assembly is mounted, in a conventional manner, to the filling aperture of the container. According to a preferred embodiment of the invention, such a pick-up tube assembly comprises:

(a) a platform member adapted to be positioned in contact with the bottom of a container at a location substantially opposite the container's liquid access opening when the pick-up tube is being used to aspirate liquid from such container, such platform having a liquid passageway extending between a pair of surfaces thereof, (b) a disk-shaped member having opposing surfaces and means defining a liquid passageway between such surfaces, such disk-shaped member being adapted to be retained in a position proximate the container's liquid filling aperture when the pick-up tube is in use;

(c) a flexible and resilient conduit interconnecting the respective liquid passageways in the platform and disk-shaped members, such flexible conduit being capable of conducting liquid from the container; and (d) mounting means for movably mounting the platform and disk-shaped members for relative movement toward and away from each other.

Preferably, the conduit is resilient, comprising rubber, silicone, polyurethane, thermoplastic elastomer or the like, and the mounting means comprises a telescoping arrangement including a first and second rigid tubes of different diameter, one tube having an end rigidly connected to the platform member, and the other tube having an end rigidly connected to the disk-shaped member, such tubes extending toward each other and being concentrically arranged with respect to each other, whereby one tube slides within the other as the platform and disk-shaped member are moved toward and away from each other. Means are provided for biasing the platform and disk-shaped members apart, i.e., in directions away from each other, whereby the platform member engages the container bottom while the disk-shaped member is retained at a location proximate the container's filling aperture.

The invention and its advantages will be better understood from the ensuing detailed description of preferred embodiments, reference being made to the accompanying drawings in which like reference characters denote like parts.

DETAILED DESCRIPTION OF PREFERRED EMBODIMENTS

Figure 1:
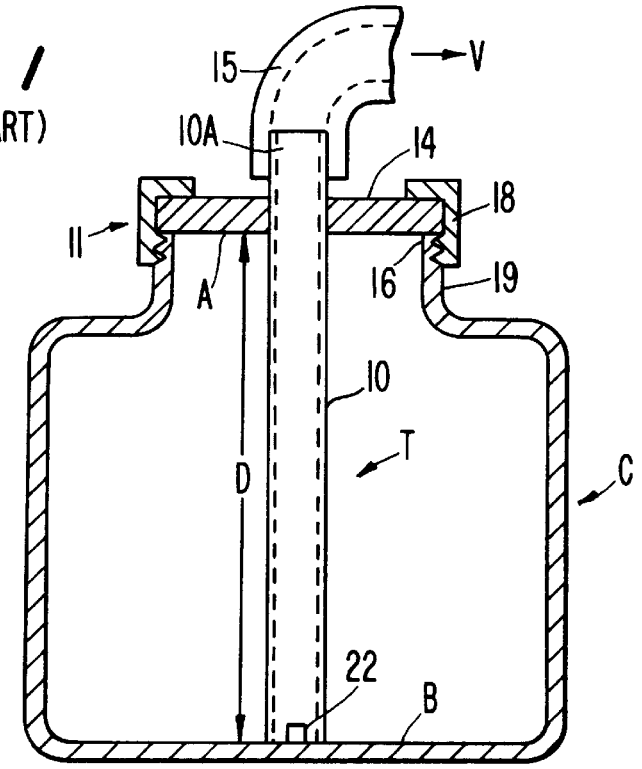
FIG. 1 (PRIOR ART)
FIG. 1 depicts a prior art pick-up tube assembly in cross-section.
Figure 2:
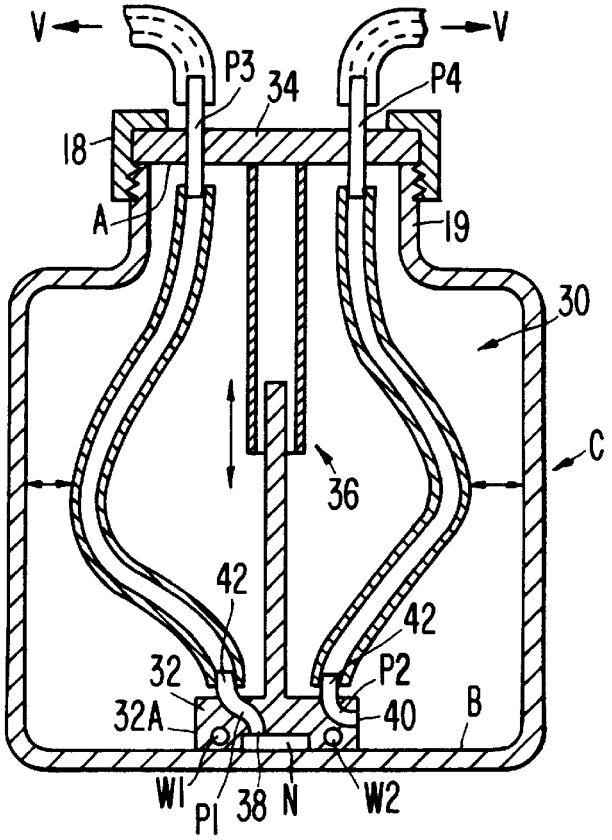
FIG. 2 is a cross-sectional illustration of a pick-up tube assembly structured in accordance with a preferred embodiment of the invention.

Referring now to FIG. 2, a self-adjusting pick-up tube assembly 30, structured in accordance with a preferred embodiment of the invention, is shown as comprising a platform member 32, a disk-shaped member 34, a pair of interconnecting flexible conduits 35, and movable mounting means 36 by which the platform and disk-shaped members are mounted for relative movement towards and away from each other. In use, platform member 34 rests upon the container bottom B, opposite the container's filling aperture A, while the disk-shaped member rests upon the circular rim surrounding the filling aperture and is clamped thereto by a threaded cap 18. The flexible conduits preferably comprise a resilient material, such as rubber, silicone, polyurethane or some other thermoplastic elastomer.

Figure 3A:
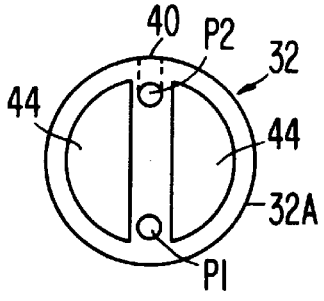
FIGS. 3A, 3B and 3C are top, bottom and side plan views, respectively, of the platform member comprising the FIG. 2 apparatus.
Figure 3B:
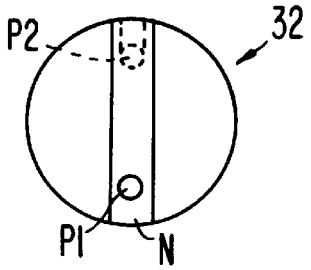
Figure 3C:
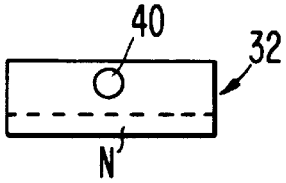

Referring additionally to FIGS. 3A and 3B, platform member 32 defines a pair of internal liquid passageways P1 and P2 through which liquid can be drawn from the container. Passageway P1 communicates with an inlet 38 located in the base of a notch N formed in the platform's bottom surface, and passageway P2 communicates with an inlet 40 formed in a side wall 32A of the platform. As shown in FIG. 3C, the location of inlet 40 is slightly above the base of notch N so that, as the container empties, air in the container will be drawn through inlet 40 before it is through inlet 38, thereby providing a means for sensing a low level (i.e. near empty) condition. Each of the passageways P1 and P2 communicates with a short tubular member 42 extending upwardly from the top surface of the platform member, each of such members being adapted to receive one end of the flexible conduits 35. As shown in FIG. 3A, the top surface of the platform member defines a pair of hollow chambers 44 which fill with container liquid as the platform is submerged in the container. The weight of the liquid operates to weigh down the platform member, urging it into contact with the container bottom. Optionally, metal weights W1 and W2 may be incorporated in the platform to further assist in urging the platform to the container bottom. Preferably, the platform and disk-shaped members are made of plastic.

Figure 4:
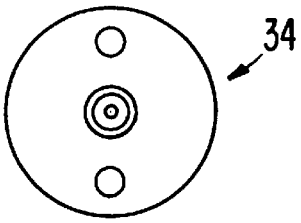
FIG. 4 is a top plan view of the disk-shaped member of the FIG. 2 apparatus.

Referring additionally to FIG. 4, disk-shaped member 34 is provided with a pair of liquid passageways P3 and P4 which extend between the opposing surfaces of the disk. Tubular members 50 extend through each of such passageways, one end of each member being adapted to receive and couple to an end of the flexible conduit 35, and the opposite end being adapted to receive and couple to an end of a conduit 15 to which a vacuum source is applied to aspirate liquid from the container. Preferably, a small vent hole 52 is formed at the center of the disk-shaped member to equalize the pressure inside the container with that outside the container.

Figure 5A:
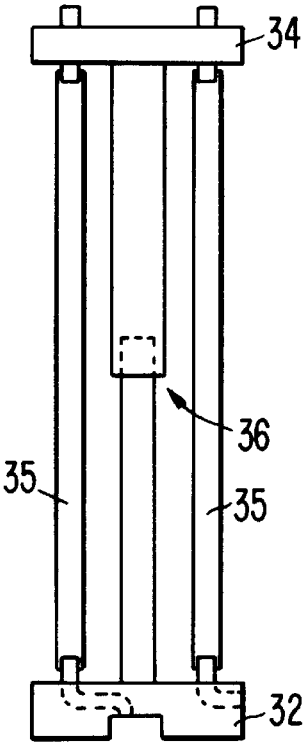
FIGS. 5A and 5B are side elevations showing the pick-up tube assembly of FIG. 2 in its extreme positions.
Figure 5B:
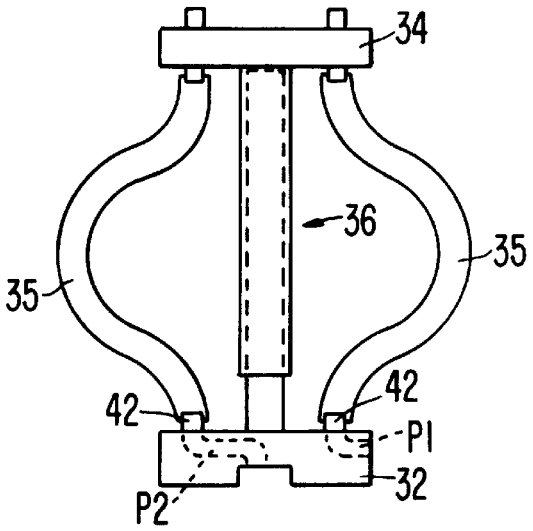

As noted above, an important feature of the pick-up tube assembly of the invention resides in its ability to be used to empty containers of varying height. This feature is provided by enabling platform member to self-adjust its spacing from the disk-shaped member. Preferably, this self-adjustment feature is provided by the telescopic arrangement shown in FIGS. 2, 5A and 5B. More specifically, the platform member is provided with a rigid rod 54 which extends upwardly from the central portion of the top surface thereof and slides within a rigid tube 56 extending downwardly from the bottom surface of the disk-shaped member. The flexible liquid conduits 35, when extended to their maximum length, as shown in FIG. 5A, prevent disengagement between the rod and tube. As members 32 and 34 move towards each other, as occasioned by placing the tube assembly in a container having a height shorter than the maximum allowed spacing between member 32 and 34, the liquid conduits 35 flex, as shown in FIGS. 2 and 5B, to accommodate the shorter spacing.

Figure 6:
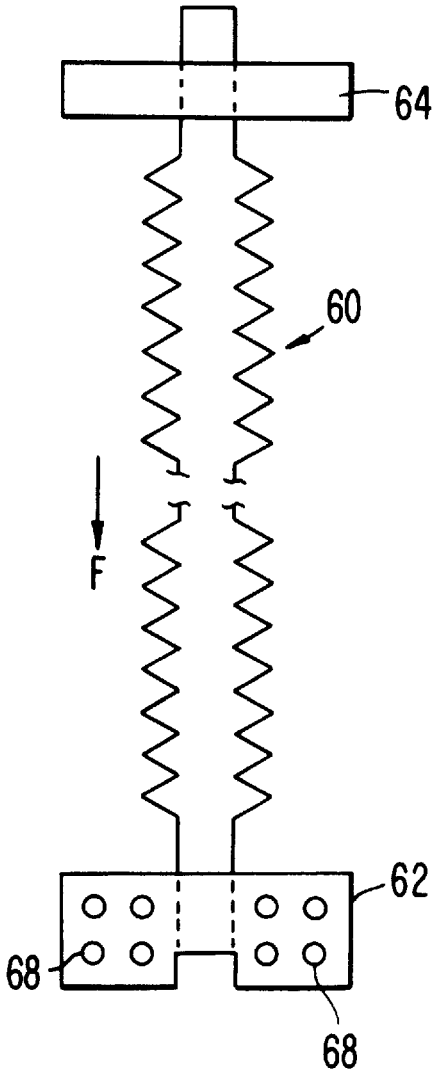
FIG. 6 illustrates an alternative embodiment of the invention.

An alternative to the preferred embodiment discussed above is shown in FIG. 6. As illustrated, a self-adjusting pick-up tube may comprise a bellows-style conduit 60 made of a flexible and resilient material, such as rubber. The length of the conduit is adjustable by applying a longitudinal force F, as may be produced by bonding weights 68 to the platform member 62. As in the case of the assembly discussed above, the conduit is attached to a disk-shaped member 64 adapted to be clamped to the filling aperture of a liquid container.

While the invention has been described with reference to certain specific embodiments, it will be appreciated that variations can be made without departing from the spirit of the invention, and such variations are intended to fall within the scope of the following claims. For example, the pick-up tube assembly may have only one or a multitude of flexible conduits for aspirating liquid from the container. In the case of multiple conduits, the conduits may be of the same outside diameter or be of different diameters to accommodate different size vacuum hoses.

What is claimed is:

1. A pick-up tube assembly for aspirating a liquid from a liquid-containing container having a filling aperture in a wall thereof, said assembly comprising:

(a) a platform member adapted to be positioned in contact with the bottom of a container at a location substantially opposite the container's liquid access opening when the pick-up tube is being used to aspirate liquid from such container, such platform having a liquid passageway extending between a pair of surfaces thereof;

(b) a disk-shaped member having opposing surfaces and means defining a liquid passageway between such surfaces, such disk-shaped member being adapted to be retained in a position proximate the container's liquid access opening when the pick-up tube is in use;

(c) a flexible conduit interconnecting the respective liquid passageways in the platform and disk-shaped members, such flexible conduit being capable of conducting liquid from the container; and (d) mounting means for movably mounting the platform member for movement relative to said disk-shaped member to enable said platform member to move towards and away from said disk-shaped member.

2. The invention as defined by claim 1 wherein said mounting means comprises a telescoping arrangement including a first and second rigid tubes of different diameter, one tube having an end rigidly connected to said platform member, and the other tube having an end rigidly connected to said disk-shaped member, said tubes extending toward each other and being concentrically arranged with respect to each other, whereby one tube slides within the other as said platform and disk-shaped member are moved toward and away from each other.

3. The apparatus as defined by claim 1 wherein said flexible tube has a substantially rectilinear shape when no external forces are applied thereto, and wherein said biasing function is provided by a restoring force in said flexible tube tending to restore said flexible tube to a rectilinear shape whenever an external force causes said flexible tube to flex to a non-rectilinear shape.

4. The apparatus as defined by claim 1 wherein said platform comprises top and bottom surfaces which are spaced apart and interconnected by an endless surface therebetween, and wherein said passageway extends between said top and bottom surfaces.

5. The apparatus as defined by claim 4 wherein one end of the liquid passageway in said platform is disposed within a slot formed in the bottom surface of said platform, whereby liquid may flow unimpeded by said platform from the bottom of said container into the liquid passageway of said platform.

6. The apparatus as defined by claim 1 wherein said platform comprises top and bottom surfaces which are spaced apart and interconnected by an endless surface therebetween, and wherein said passageway extends between said top and endless surfaces.

7. The apparatus as defined by claim 1 wherein said platform comprises a material having a density less than the density of liquid in said container, and wherein the upper surface of said platform defines a chamber into which liquid in said container may flow when said tube is in use, the weight of such liquid contained by said chamber acting to further bias said platform and disk-shaped members apart so that said platform tends to remain in contact with the container's bottom.

8. The apparatus as defined by claim 1 wherein said disk-shaped member is provided with a second aperture for admitting air into said container.

9. The apparatus as defined by claim 2 wherein said disk-shaped member is provided with second aperture for admitting air into said container, and wherein said second aperture is surrounded by one of said rigid tubes comprising said telescoping arrangement.

10. The apparatus as defined by claim 1 further comprising a tubular member communicating with the liquid passageway in the disk-shaped member and extending outwardly from one surface of the disk-shaped member, such tubular member being adapted to be connected to a source of negative pressure when said tube is in use.

11. The apparatus as defined by claim 1 wherein said flexible conduit comprises an endless wall defining a bellows structure by which the length of said conduit can be varied by applying a longitudinal force parallel to the longitudinal axis of said conduit.

12. The apparatus as defined by claim 1 wherein said flexible conduit comprises a material selected from the group consisting of silicone, polyurethane, rubber and thermoplastic elastomer.

* * * * *